United States Patent [19]

Betz et al.

[11] Patent Number: 4,582,682

[45] Date of Patent: Apr. 15, 1986

[54] METHOD OF PRODUCING MOLDED PARTS BY COLD ISOSTATIC COMPRESSION

[75] Inventors: Wolfgang Betz, Gauting; Werner Hüther, Karlsfeld, both of Fed. Rep. of Germany

[73] Assignee: MTU Motoren-und Turbinen-Union Munchen GmbH, Munich, Fed. Rep. of Germany

[21] Appl. No.: 636,371

[22] Filed: Jul. 31, 1984

[30] Foreign Application Priority Data

Aug. 11, 1983 [DE] Fed. Rep. of Germany ..... 3328954

[51] Int. Cl.[4] ..... B22F 1/00

[52] U.S. Cl. ..... 419/68; 419/38; 419/39; 419/42; 419/49; 419/60; 419/66; 264/101; 264/109; 264/DIG. 78; 425/78; 425/405 H; 425/DIG. 44

[58] Field of Search ..... 419/68, 66, 42, 49, 419/60, 38, 39; 264/101, 109, DIG. 78; 425/78, 405 H, DIG. 44

[56] References Cited

U.S. PATENT DOCUMENTS

| | | | |
|---|---|---|---|
| 3,383,208 | 5/1968 | Corral | 419/42 |
| 3,531,848 | 10/1970 | Gripshover et al. | 419/42 |
| 3,577,635 | 5/1971 | Bergmann et al. | 419/42 |
| 3,929,476 | 12/1975 | Kirby et al. | 419/42 |
| 3,956,452 | 5/1976 | Saito | 419/42 |
| 4,526,747 | 7/1985 | Schimmel et al. | 419/68 |

*Primary Examiner*—Stephen J. Lechert, Jr.
*Attorney, Agent, or Firm*—Roberts, Spiecens & Cohen

[57] ABSTRACT

A thin-walled elastic envelope or mold element is arranged within a divisible outer supporting mold of porous material and a vacuum is applied to the outer supporting mold. Thereupon powdered metal or ceramic is introduced into the elastic mold element and the mold element is closed and pressurized to form a preform. The preform is then subjected to cold isostatic pressurization which is applied to the outer surface of the elastic mold element. Prior to the cold isostatic pressurization, the vacuum applied to the outer supporting mold is terminated and a vacuum is produced within the elastic mold element.

9 Claims, 1 Drawing Figure

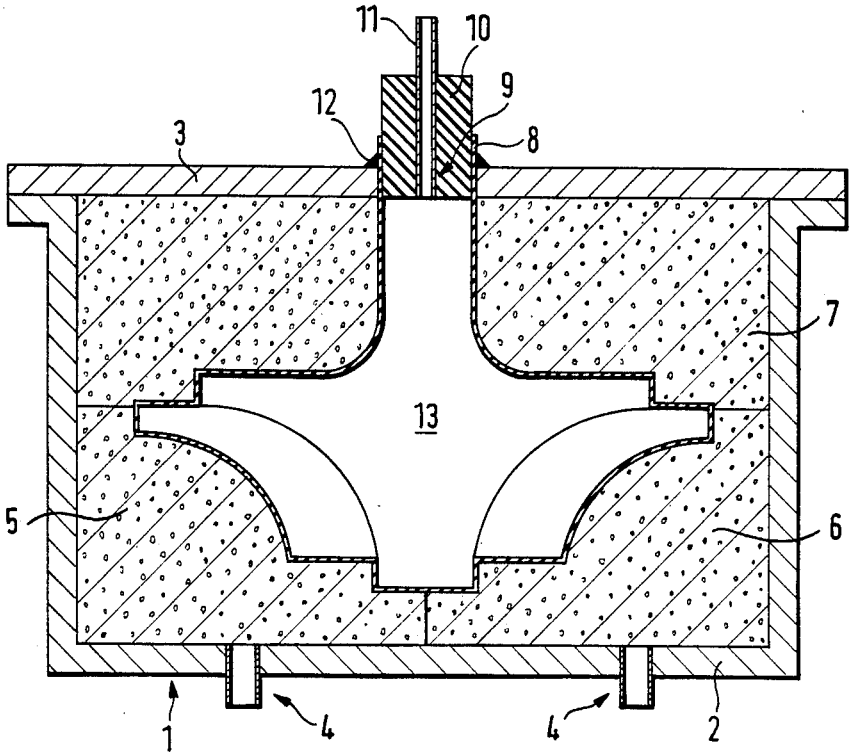
11
10
9
12
8
3
7
13
5
6
1
4
4
2

METHOD OF PRODUCING MOLDED PARTS BY COLD ISOSTATIC COMPRESSION

FIELD OF THE INVENTION

The invention relates to a method of producing molded parts by cold isostatic compression, and particularly to a method in which an elastic membrane or envelope is utilized for the formation of parts of complex contour such as turbine wheels.

BACKGROUND

Methods of producing preforms from powdered metal or ceramic by cold isostatic compression are known in the art.

In one method, the powder is introduced into an elastic mold (for example, of rubber) and is compressed at a hydrostatic pressure of 500 to 6000 bars. By the insertion of cores it is also possible to produce an inner contour for the molded part.

Complex outer contours, for instance, of turbine wheels, cannot be produced by the known methods. This is because the elastic mold springs back upon the removal of the pressure and still rests against the molded body. As a result, forces directed radially outwards and/or axially are transmitted to the preform and may lead to the destruction of delicate regions of the preform, such as thin-walled regions.

DE-OS No. 14 83 684 discloses a method of manufacturing molded parts, particularly parts of complex outer contours, by cold isostatic compression in which an impermeable thin-walled elastic envelope is applied against the inner wall surface of a divisible outer supporting mold part of porous material by subjecting the external supporting mold part to a vacuum, whereafter the elastic envelope is filled with pulverulent molding material and closed and then subjected to cold isostatic compression pressure.

The advantage of this method is that high precision of shape can be obtained without inordinately high expenses for the molding. The thin-walled elastic envelope filled with the pulverulent molding material, however, has no inherent stiffness of its own so that the supporting mold parts are required during the cold isostatic compression step to assure the desired outer contour of the molded part. However, this imposes considerable limitations as regards the outer contours which can be produced. Thus, for instance, molded parts which have greatly curved contours with undercuts cannot be produced by the aforementioned method since, upon the contraction which takes place during the course of the isostatic compression there would be contact with the outer supporting mold. However, even if contact with the outer supporting mold, as a result of the contraction due to molding was not a concern, there would nevertheless be the danger that, since the outer supporting mold does not simultaneously contract, forces leading to the formation of cracks are produced in the molded part to be compressed.

SUMMARY OF THE INVENTION

An object of the present invention is to provide a method of manufacturing a molding by cold isostatic compression of the aforementioned type in which complex shapes can be accurately formed at minimum expense without limitation of the contour to be produced or the requirement of additional work.

In accordance with the invention, this is achieved in that in a method employing the elastic envelope, after the powder has been introduced into the envelope, the vacuum at the outer supporting mold is terminated and a vacuum is produced in the envelope, and that the outer supporting mold is removed prior to the cold isostatic pressurization.

The main advantage of the method of the invention is that, upon the cold isostatic pressurization itself, the preform is surrounded only by the thin-walled elastic envelope and thus no limitations are imposed with respect to the contour which can be produced. Despite the merely thin-walled elastic envelope, the preform, however, has maximum dimensional stability which is obtained in the manner that, prior to separation from the outer supporting mold, a vacuum is produced within the envelope. The vacuum has the result that the individual particles of powder are no longer displaceable with respect to each other and the contour obtained from the external supporting is therefore retained with utmost precision. In this way, extreme fidelity of shape of the completely pressed molding can be obtained.

One advantageous embodiment of the method of the invention is characterized by the fact that the outer supporting mold is contained within a closed container having connecting lines for the production of vacuum or pressure in the mold cavity and for the introduction of the pulverulent material. Because of this construction, the method of the invention is suitable for mass production.

It is advantageous for the elastic envelope to have a wall thickness of 0.1 to 1 mm and be formed, as known, of rubber material. For carrying out the method of the invention, a particularly small wall thickness is important since in that way it is insured that the membrane stress in the envelope remains sufficiently small as not to counteract the pressure which results from the atmospheric pressure and the weight of the powder upon the introduction of the pulverulent material. Finally, it is advantageous to use glass frit, sintered metal, or porous ceramic as the material of the outer supporting mold.

It has been found that the method of the invention can be used to particular advantage for the manufacture of a compressor or turbine wheel.

BRIEF DESCRIPTION OF THE DRAWING

One illustrative embodiment of the method of the invention will be described hereafter with reference to the sole figure of the accompanying drawing which diagrammatically illustrates in cross-section, apparatus for carrying out the method of the invention.

DETAILED DESCRIPTION

In the drawing is seen an apparatus 1 for the manufacture of a radial turbine wheel preform adapted for subsequent cold isostatic compression.

The apparatus 1 comprises an outer closed container 2 having a cover 3. In the bottom of the container 2 are connecting lines 4 for establishing a vacuum or positive pressure within the container. The cover 3 is provided at its center with a filling opening which supports an elastic envelope 8, of thin-wall rubber which extends into the interior of the container. The rubber envelope 8 is closed within the interior of the container and is contained within an inner cavity which is formed by divisible outer supporting mold parts 5,6 and 7. The supporting mold parts 5,6 and 7 are, in turn, contained in form-locked fashion within the closed container 2. A filling portion 9 of the elastic envelope 8 is connected to the cover 3 via an airtight connection such as weld 12. The filling portion 9 is closed by a rubber plug 10 having a vacuum line 11 therein.

The supporting mold parts 5, 6 and 7 are made of porous material, in particular, glass frit, sintered metal or porous ceramic. The mold is openable or divisible so that the preform can be removed after its formation.

In operation, the mold parts 5,6,7 are mounted within the container to form the inner molding cavity. The connecting lines are mounted in place and the rubber envelope is contained within the cavity within the mold parts.

If the interior of the apparatus 1 is evacuated via the vacuum lines 4, the elastic, thin-walled envelope 8 is inflated by the air pressure in its interior and the envelope applies itself against the inner surface of the porous supporting mold parts to adapt its shape to the contour of the cavity defined therein. A powder 13, to be compressed, is then introduced through the filling portion 9 of the elastic envelope 8 and the filling portion 9 is then closed by the rubber plug 10 containing the vacuum line 11. The vacuum lines 4 are then opened so that air flows into the porous supporting mold parts 5, 6, 7. The air is suctioned out from the inflated elastic envelope 8 through the vacuum line 11 in the rubber plug 10. Atmospheric pressure now acts on the outer surface of the elastic envelope 8 and thus also on the powder 13 contained therein. The pressure on the powder 13 produces friction within the powder 13 which is so great that the part to be formed by compression no longer becomes deformed. In other words, the powder is sufficiently compressed to form a self-sustaining preform. Thereupon, the vacuum line 11 in the plug 10 is closed, the mold parts 5,6,7 are removed and the part surrounded by the rubber envelope is cold isostatically compressed.

A complex molded part, such as a turbine wheel which has a precise outer contour can thus be produced in simple fashion by the invention. The invention is based on the discovery that, as a result of the extremely thin-walled elastic envelope 8, the envelope upon springing back upon the removal of the cold isostatic compression pressure transmits only small radially outwardly directed or axial forces to the part to be produced. Nevertheless, due to the initial presence of the outer supporting parts 5, 6, 7, the elastic envelope 8 is of sufficient mechanical strength in order that there are no changes in shape upon the introduction of the powder 13.

Although the invention has been described in relation to a specific embodiment thereof, it will become apparent to those skilled in the art that numerous modifications and variations can be made within the scope and spirit of the invention as defined in the attached claims.

What is claimed is:

1. In a method for the manufacture of a molded part of complex outer contour, by cold isostatic compression, in which an impermeable, thin-walled elastic envelope rests against the inner surface of a divisible outer supporting mold of porous material and the outer supporting mold is subjected to a vacuum and the elastic envelope is then filled with pulverulent molding material and closed and then subjected to a cold isostatic compression, the improvement comprising terminating the vacuum applied to the porous outer supporting mold after the introduction of the powder into the elastic envelope, applying a vacuum in the elastic envelope to pressurize the pulverulent molding material to form a self-sustaining preform surrounded by said elastic envelope, and removing the outer supporting mold prior to the application of cold isostatic compression pressure.

2. The improvement as claimed in claim 1 wherein the outer supporting mold is contained within a closed container which has connecting lines for selectively producing vacuum or positive pressure and an opening for the introduction of the pulverulent material.

3. The improvement as claimed in claim 1 wherein the elastic envelope is formed with a wall thickness of 0.1 to 1 mm.

4. The improvement as claimed in claim 1 wherein the elastic envelope is formed of rubber.

5. The improvement as claimed in claim 1 wherein the outer supporting mold is formed of glass frit, sintered metal or porous ceramic.

6. The improvement as claimed in claim 1 wherein the molded part of complex shape is a compressor or turbine wheel.

7. A method of manufacturing a molded part of complex outer contour comprising providing an openable mold with porous divisible parts defining a molding cavity having the desired outer contour of a molded part, supporting an elastic envelope in said mold so as to extend into said cavity, subjecting the porous parts to a vacuum while pressurizing the interior of the envelope to press the envelope against the porous parts and assume the shape of the molding cavity, introducing into the elastic envelope a pulverulent material which is to form the desired molded part, applying vacuum to the interior of the elastic envelope and pressure to the exterior of the elastic envelope to pressurize the pulverulent material to form a self-sustaining preform, removing said divisible parts and effecting cold isostatic compression of the preform along with the surrounding elastic envelope in the absence of said parts.

8. A method as claimed in claim 7 wherein the pressure applied to the exterior of the elastic envelope in the formation of said preform is atmospheric.

9. A method as claimed in claim 7 wherein the pressure in the interior of the enveolpe when the envelope is pressed against the porous parts is atmospheric.

* * * * *